US005392814A

United States Patent [19]

Brotcke et al.

[11] Patent Number: 5,392,814

[45] Date of Patent: Feb. 28, 1995

[54] WATER WELL REHABILITATION APPARATUS

[75] Inventors: Paul Brotcke, Kirkwood; Joseph Foppe, Fenton, both of Mo.

[73] Assignee: Brotcke Engineering Company, Inc., Fenton, Mo.

[21] Appl. No.: 68,211

[22] Filed: May 27, 1993

[51] Int. Cl.[6] ..... A01G 25/09

[52] U.S. Cl. ..... 137/899; 137/565; 166/75.1

[58] Field of Search ..... 137/899, 565; 166/75.1, 166/90

[56] References Cited

U.S. PATENT DOCUMENTS 1,558,796 10/1925 Dunn .
2,178,194 10/1939 Williams .
2,745,555 5/1956 Hewey .
2,802,537 8/1957 Goldinger .
3,053,320 9/1962 Steincamp ..... 166/75.1
3,228,472 1/1966 Rhoads, Jr. ..... 166/75.1
3,280,841 10/1966 Deutsch ..... 137/899
3,433,417 3/1969 Poppitz .
3,589,614 6/1971 Linville .
3,633,669 1/1972 True ..... 166/75.1
3,858,761 1/1975 O'Dell .
4,064,936 12/1977 McClure ..... 166/75.1
4,132,268 1/1979 Harrison ..... 166/75.1
4,323,122 4/1982 Knopik ..... 166/75.1
4,597,437 1/1986 McNabb ..... 166/75.1

*Primary Examiner*—A. Michael Chambers
*Attorney, Agent, or Firm*—Ronald N. Compton

[57] ABSTRACT

A vehicle employed in the rehabilitation of water wells comprises a 3,000 gallon capacity tank and a 135 horsepower hydraulic pump connected in fluid communication with the tank through a network of fluid conducting conduits providing an apparatus that transports all of the necessary equipment to a water well location for rehabilitation of the well.

18 Claims, 3 Drawing Sheets

WATER WELL REHABILITATION APPARATUS

BACKGROUND OF THE INVENTION (1) Field of the Invention

The present invention pertains to a vehicle employed in the rehabilitation of water wells. Specifically, the present invention pertains to a vehicle mounting a 3,000 gallon-capacity tank and a 135 horsepower hydraulic pump connected in fluid communication with the tank through a network of fluid conducting conduits that together provide an apparatus that transports all of the necessary equipment to a water well location for rehabilitation of the well.

(2) Description of the Related Art

Water wells are formed by drilling the well downward through the ground to a certain depth where the well intersects one or more aquifers or water bearing stratum of permeable rock, sand, or gravel. Water in the aquifer(s) flows through the permeable rock, sand, or gravel and fills the drilled well to a certain depth. As water is pumped from the well, water continues to flow through the spaces between the permeable rock, sand, or gravel back into the well. A well's efficiency is rated by its specific capacity (SC) which is defined as the ratio of gallons per minute of water being pumped from the well divided by the number of feet of draw down or the number of feet the water level decreases in the well.

A new well constructed properly should have an efficiency approaching 100%. However, after a well has been used over a period of time, the spaces between the permeable rock, sand, or gravel in the aquifer(s) intersected by the well will often become blocked with dissolved minerals in the ground water traveling through the aquifer(s) or blocked biologically, for example by iron bacteria that feed on amounts of iron carried in the ground water. The blockage of the spaces between the rock, sand, or gravel creates an increased resistance to the flow of water through the aquifer(s) to the well and results in a lower pumping level of the water in the well and subsequently, a lower specific capacity (SC) of the well. Should the situation go unremedied and allowed to continue without well cleaning being performed, the specific capacity of the well could be reduced to the point that the well would no longer be useful requiring a new well to be drilled.

Water wells require periodic maintenance and cleaning to maintain their specific capacities. Well rehabilitation is the art of thoroughly cleaning mineral and biological deposits from the well to increase the specific capacity of a deteriorated well.

In the prior art, mechanical well cleaning methods and acid injections have been used to rehabilitate water wells. However, in many situations these have proven to be ineffective. This is due in part because the mechanical methods or chemical treatments that are used to remove or dissolve the minerals and bacteria causing the blockage of the aquifer only reach the face of the blocked aquifers. High pressure injection procedures have been developed to overcome this shortcoming by using sustained injection pressures of cleaning chemicals. The high pressure injection of the chemicals forces the chemical treatment to all sections of the well system and adjacent areas of the aquifers feeding ground water to the well. Injection rates from less than 100 gallons per minute (GPM) to over 4,000 GPM have been found to be necessary to effectively clean the wide range of potable water and industrial wells existing in the United States. The equipment necessary to perform the high pressure injection procedure at first involved the use of a 1,000 gallon tank, a 25 HP electric injection pump, a generator to power the pump, and a plurality of lengths of hoses and hose couplings required to connect the tank with the pump and connect the pump with the well. This prior art method of high pressure injection well cleaning was later improved to include a 2,000 gallon capacity tank and a 75 HP injection pump. However, these prior art methods all involved an external power source and proved to be inefficient due to the necessity of transporting the separate tank, generator, pump, and hose lengths and couplings to the well site and due to the constant changing of valves, fittings, and hoses required in rehabilitating the well.

SUMMARY OF THE INVENTION

The well rehabilitation apparatus of the present invention overcomes disadvantages encountered in prior art methods of rehabilitating water wells by providing a vehicle transporting the necessary equipment for high pressure injection cleaning of water wells. Generally, the apparatus of the present invention is comprised of a wheeled platform supporting a 3,000 capacity tank, a 135 HP hydraulic pump, a hydraulic motor connected to the pump, and a network of fluid conducting conduits connected between the tank and pump. The network of conduits includes a manifold having a plurality of branch conduits including an output conduit supplying liquid contained in the tank to the well being rehabilitated, an input conduit providing fluid communication back from the well to the manifold, a discharge conduit providing fluid communication from the manifold away from the vehicle and the well, and a return conduit providing fluid communication between the manifold and the tank interior. A pair of fill conduits are also communicated with the tank interior volume for use in filling the tank with a liquid. An operator's platform is provided at the rearward end of the vehicle. A plurality of manually operated valves are provided on the manifold branch conduits and the fill conduits enabling an operator of the apparatus standing on the platform to easy access any one of the plurality of valves to control the flow rate of liquid through the conduit associated with the valve.

The novel construction of the well rehabilitation apparatus of the invention enables an operator of the apparatus to stand on the platform off the ground's surface and operate the control valves and control the hydraulic pump from one location. Once a well treatment crew has connected hoses to and from the well to the manifold branch conduits, the operator can control all functions from the operator's platform. A flow of liquid can be recirculated in the tank for mixing chemicals, and injected into the well at variable rates, or discharged from the apparatus or directed to a test meter for test measurements.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
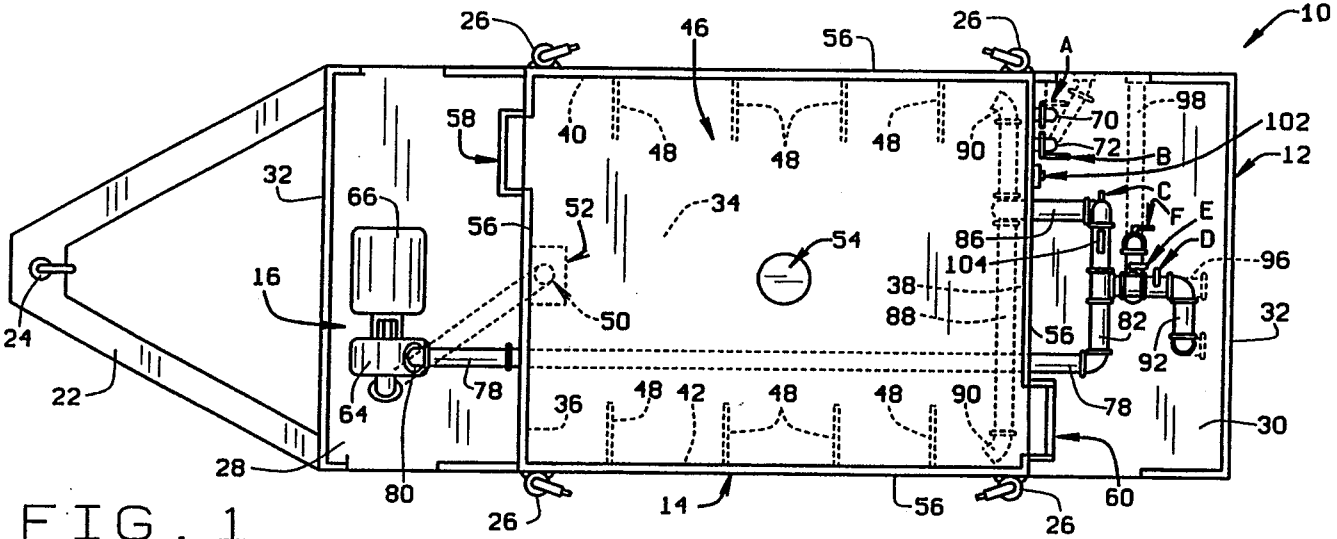
FIG. 1 is a top plan view of the apparatus of the invention.

FIGS. 1 through 5 show various views of the well rehabilitation apparatus 10 of the present invention. Generally, the apparatus is comprised of a wheeled vehicle 12, a large capacity tank 14 supported on the vehicle and a pumping system 16 also supported on the vehicle. The wheeled vehicle 14 in the preferred embodiment is a trailer. However, the apparatus of the invention is equally well suited to be supported on the chassis of a truck and it should be understood that referring to the apparatus as being supported on a wheeled vehicle 12 is intended to be interpreted broadly to include a trailer, truck or other similar type of transportation vehicle.

Figure 2:
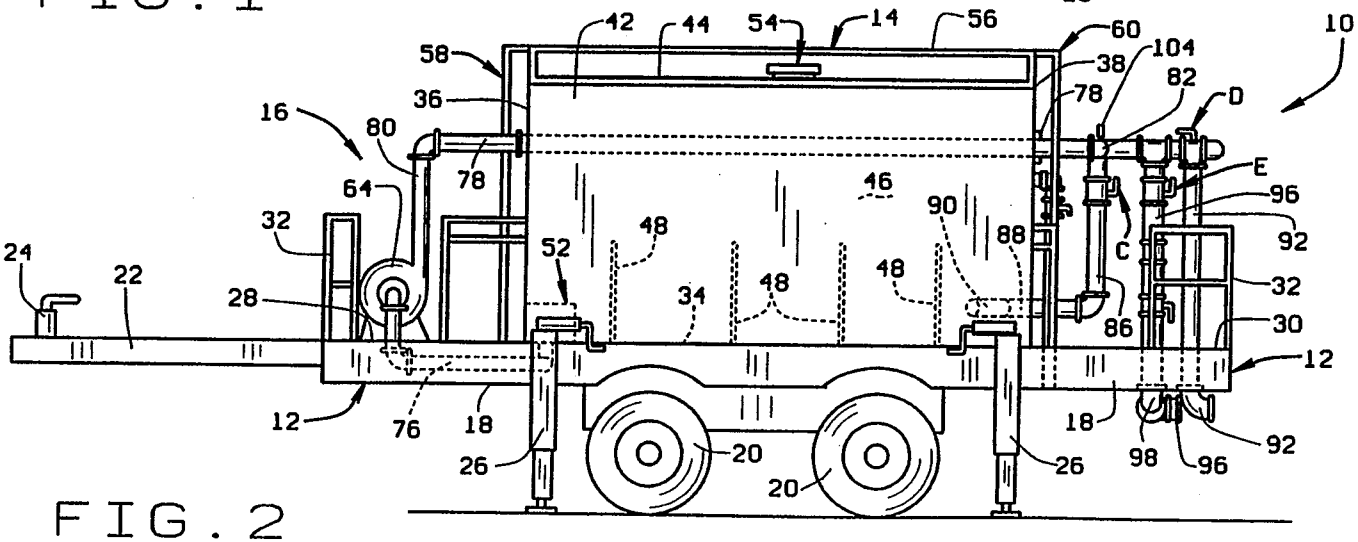
FIG. 2 is a right side elevation view of the apparatus of the invention.
Figure 3:
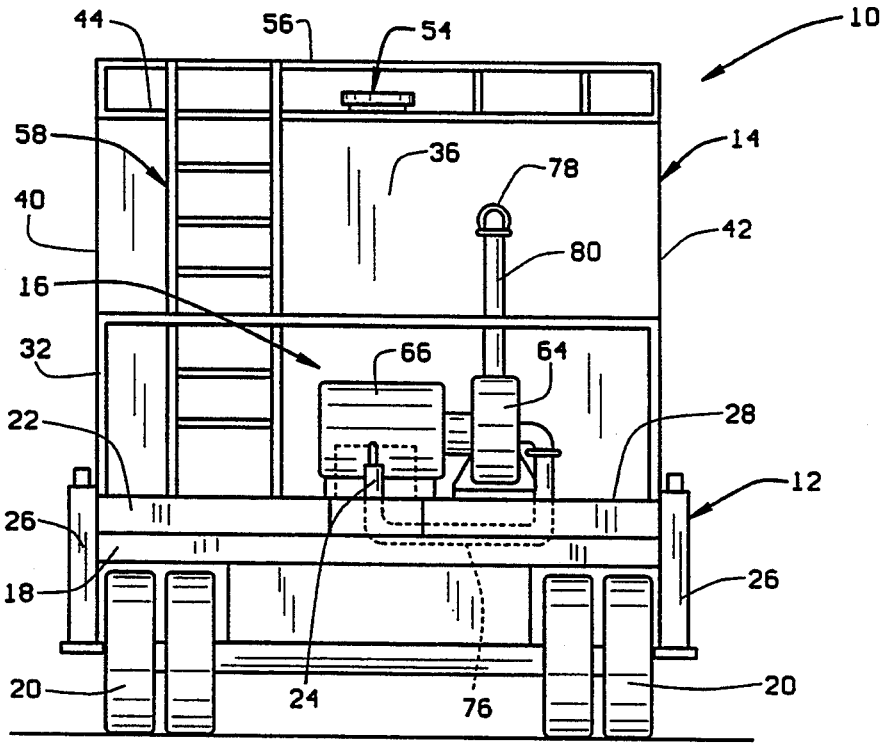
FIG. 3 is a front elevation view of the apparatus.
Figure 4:
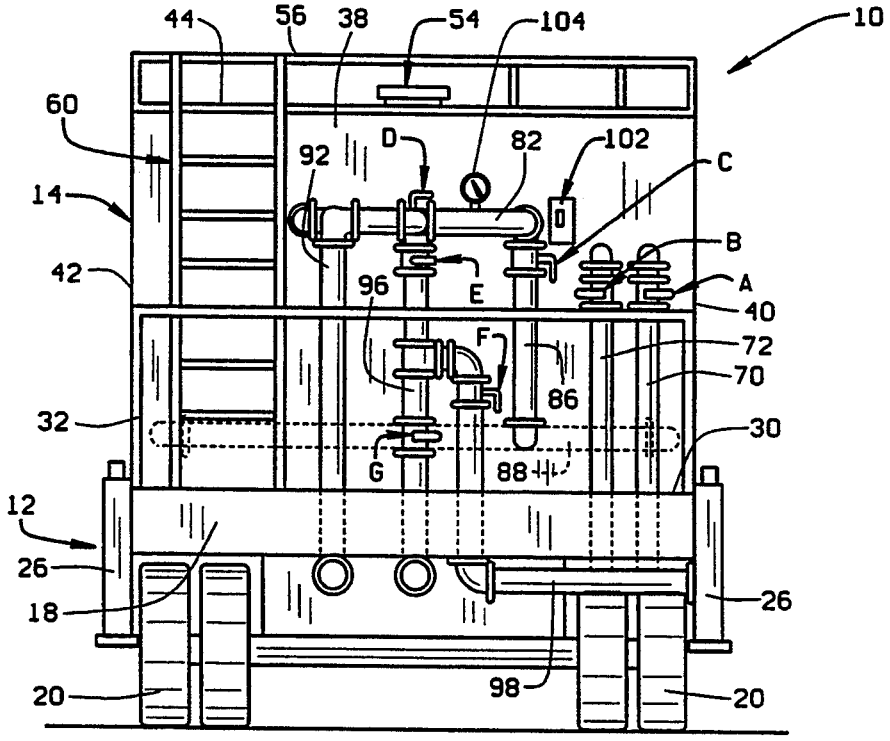
FIG. 4 is a rear elevation view of the apparatus.
Figure 5:
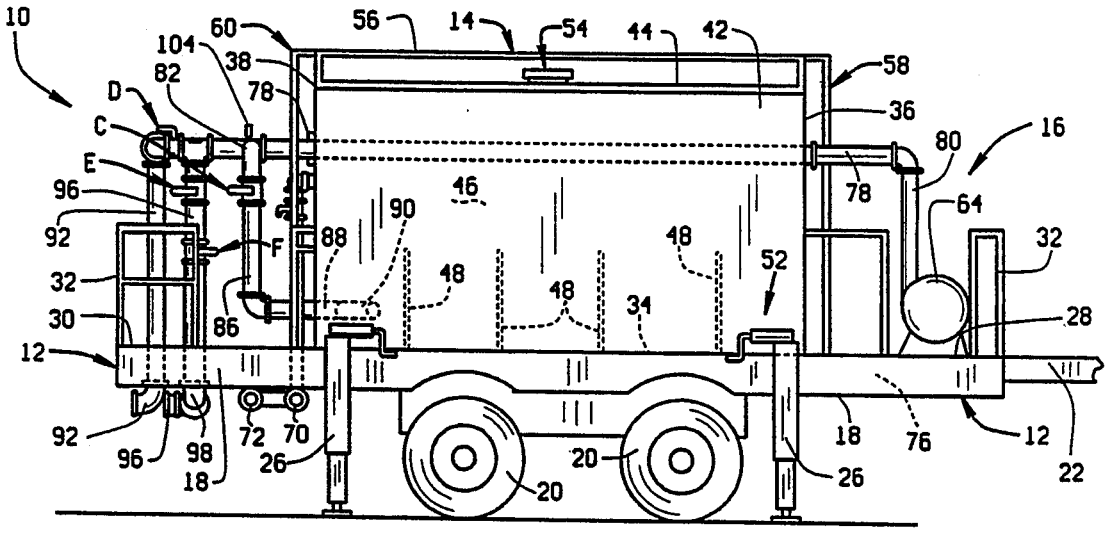
FIG. 5 is a left side elevation view of the apparatus.

The wheeled vehicle, or trailer 12, as shown in the drawing figures is constructed in a conventional manner but with a reinforced chassis 18 to support the weight of the component parts of the invention, particularly the large capacity tank 14 when filled with liquid. The chassis 18 is supported for transportation by tandem wheels 20 on which the chassis is mounted by a conventional suspension system (not shown). A tongue assembly 22 projects from the forward end of the trailer chassis 18 and a hitch. 24 is provided on the tongue assembly for connection to a towing vehicle. Four manually operated jacks 26 are positioned around the chassis 18. As shown in FIG. 2, the jacks are lowered to maintain the chassis 18 in a horizontal orientation when the apparatus is being used in a well rehabilitation procedure and is not being transported. As shown in FIG. 5, the jacks 26 are raised when the apparatus is to be transported. The chassis 18 also supports a front platform 28 at the forward end of the trailer and a rear platform 30 at the rearward end of the trailer. Railings 32 extend around portions of the two platforms.

The tank 14 is shown having a rectangular configuration but may also have other configurations. The tank is constructed having a bottom 34, front and back walls 36, 38, a left sidewall 40 and right sidewall 42 and a top 44. Preferably, the tank is constructed of sheets of metal welded together in a fluid tight box configuration enclosing the interior volume 46 of the tank. A plurality of generally triangular gusset plates 48 are welded between the tank bottom 34 and left and right sidewalls 40, 42 to reinforce the tank and also provide obstructions in the tank interior that produce turbulence in the liquid injected into the tank. The tank bottom 34 slopes downward as it extends from the tank back wall to the tank front wall 36. A drain opening 50 is provided at the center of the tank bottom adjacent the front wall 36 and the slope of the tank bottom 34 causes liquid contained in the tank interior to flow to the drain opening 50. A screened enclosure 52 is formed around the drain opening 50 to prevent debris such as sand and gravel from draining through the drain opening 50. The screened enclosure has a plate top that prevents vortexing of the liquid drained through the opening. An access opening covered by a hatch 54 is provided through the tank top wall 44. A railing 56 extends around the tank top wall and front and rear ladders 58, 60 extend upward over the front wall 36 and back wall 38 of the tank to the tank top 44. In the preferred embodiment of the invention the tank interior volume 46 has a 3,000 gallon capacity.

The pumping system 16 includes an injection pump 64 mounted to the forward platform 28 of the vehicle. In the preferred embodiment of the invention the injection pump 64 has a power rating of 135 HP. The pumping system 16 also includes a motor 66 mounted on the front platform 28 and connected in a driving connection with the injection pump 64 to power the pump. In the preferred embodiment of the invention the motor is a hydraulic motor with a power rating of 125 HP. However, other types of motors may be employed with the apparatus of the invention, for example an electric powered or a gas or diesel powered motor, without departing from the intended scope of the invention defined by the claims. The pumping system has the capacity of pumping 3,000 gallons of liquid at a rate of over 4,000 GPM.

A network of fluid conducting conduits connects the pumping system 16 in fluid communication with the tank 14. The network employs a plurality of discharge outlets and fluid input couplings in performing the high pressure injection procedures involved in rehabilitating a well with the apparatus of the invention. The conduit network includes a pair of fill conduits, with one fill conduit 70 being a two inch diameter conduit operated by a manually operated valve A and the other fill conduit 72 being a four inch diameter conduit operated by a manually operated valve B. The two different size fill conduits are provided to enable the tank interior volume to be filled by coupling either of the two conduits to a water source, the use of the particular fill conduit depending on the source of water available. Both fill conduits 70, 72 can be used together or separately to fill the interior volume of the tank. The respective manual valves A, B of the fill conduits 70, 72 are used to open and close the conduits and adjust the rate of fluid flow through the conduits.

A first, intake conduit 76 extends between the tank drain opening 50 and the pump 64 and connects the tank interior volume in fluid communication with the pump. A second conduit 78 extends from the pump output 80 through the tank front wall 36, the tank interior volume 46, and through the tank back wall 38 to a manifold 82 connecting the manifold in fluid communication with the pump 64.

The manifold 82 has a plurality of branch conduits including a return conduit 86 providing fluid communication between the manifold 82 and the tank interior volume 46. Fluid communication between the manifold 82 and the return conduit 86 is controlled manually by a manual valve C provided on the return conduit. The valve C is operated manually to open or close fluid communication out through the manifold and the return conduit or to adjust the rate of fluid flow through the manifold and return conduit.

The return conduit 86 passes through the tank back wall 38 into the tank interior volume 46 and is connected in fluid communication with a distribution conduit 88 intermediate opposite ends of the distribution conduit. The distribution conduit 88 extends across the tank bottom 34 adjacent the tank back wall 38 to its opposite ends and has a pair of dispensing nozzles 90 connected at its opposite ends for dispensing liquid into the tank interior volume and mixing liquid in the volume.

The plurality of manifold branch conduits also includes an output conduit 92 or injection conduit that is adapted to be connected to the well (not shown) to be rehabilitated by the apparatus by a length of hosing (not shown), the output conduit and length of hosing connecting the manifold 82 and the well in fluid communication with each other. Fluid communication between the manifold 82 and well through the output conduit 92 and hosing is controlled by a manual valve D provided on the output conduit. Manual operation of the valve D opens and closes fluid communication between the manifold and well through the output conduit and attached length of hose and also adjusts the rate of fluid flow from the manifold through the output conduit and length of hose to the well.

The plurality of manifold branch conduits also includes an input conduit 96 or surge line that is also adapted to be connected in fluid communication with the well (not shown) by a length of hose (not shown). The input conduit 96 and attached length of hose provide fluid communication from the well back to the manifold 82. Fluid communication through the input conduit 96 is controlled by a manual valve E provided on the conduit. The manual valve E can be manually operated to open and close fluid communication from the well through the input conduit 96 and attached length of hose to the manifold 82 and can also control the rate of fluid flow through the input conduit to the manifold.

The plurality of manifold branch conduits also includes a discharge conduit 98 that branches off from the input conduit 96. As seen in the drawing figures the discharge conduit 98 branches off from the input conduit 96 between the manual valve E controlling fluid flow through the input conduit and the distal end of the input conduit that is connected in fluid communication with the well by a length of hose (not shown). The discharge conduit 98 directs fluid flow from the input conduit 96 away from the apparatus 10 and the well. The distal end of the discharge conduit 98 from its connection to the input conduit 96 may be connected to a length of hose (not shown) to further distance liquid discharged through the discharge conduit 98 away from the apparatus 10 and the well. The discharge conduit is provided with a manually operated valve F to control fluid flow through the conduit. The valve F can be manually operated to either close or open the discharge conduit 98 or adjust the rate of fluid flow through the conduit.

An additional manually operated valve G is provided on the input conduit 96 between the connection of the discharge conduit 98 to the input conduit 96 and the distal end of the input conduit that is communicated with the well through a length of hose (not shown). This additional manual valve G is manually operated to open and close fluid communication through the portion of the input conduit 96 extending between the connection of the discharge conduit 98 and the distal end of the input conduit, and to adjust the rate of fluid flow through this portion of the input conduit.

From the description provided above, it should be appreciated that all of the manually operated valves A–G are positioned on the network of fluid conducting conduits where they are all accessible manually by an operator of the apparatus standing on the rear platform 30. This enables the apparatus to be controlled by a single operator standing on the rear platform 30. Also accessible from the rear platform is an electric switch 102 mounted on the tank back wall 38 and connected electrically to a servo control (not shown) of the hydraulic motor 66 for selectively turning the motor on and off by depressing the switch. A pressure gauge 104 is mounted on the manifold 82 to provide the operator of the apparatus standing on the rear platform 30 a visual indication of the fluid pressure in the manifold. This novel arrangement of controls of the apparatus provides the operator of the apparatus standing on the rear platform 30 with easy access to all of the manually operated controls to control the operation of the apparatus in performing the high pressure injection procedures involved in rehabilitating a water well employing the apparatus.

In use of the apparatus 10 the vehicle trailer 12 is first transported to the site of the well to be rehabilitated by the apparatus. At the well site four external connections to the fluid conduit network of the apparatus are required. The connections include connecting a supply of water to one of the two fill conduits 70, 72, connecting the output conduit 92 to the well by a length of hose, connecting the input conduit 96 to the well pump by a length of hose, and connecting the discharge conduit 98 to a length of hose extending away from the apparatus 10 or to a metering apparatus if the discharge liquid pumped from the rehabilitated well is to be tested.

Figure 6:
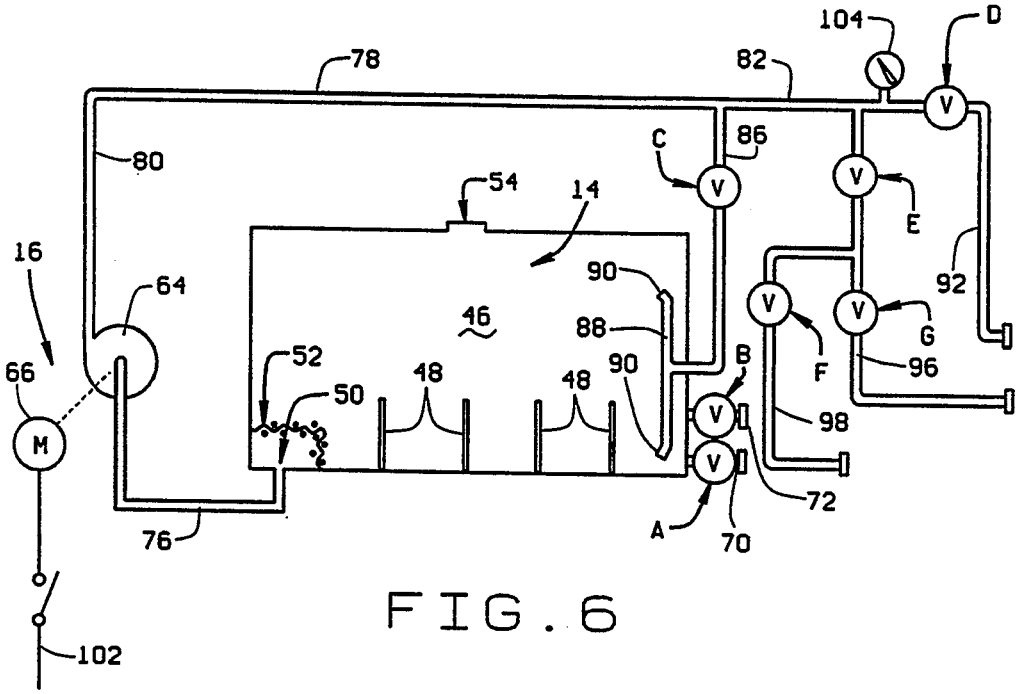
FIG. 6 is a schematic representation of the network of fluid conducting conduits of the apparatus of the invention.

The configuration of the conduit network of the apparatus enables five functions to be performed by the single apparatus once the above-described connections are made. These functions include mixing chemicals to be used in the rehabilitation process with water inside the tank interior volume, injecting the liquid contained in the tank volume into the well, filling the tank interior volume directly from the well being rehabilitated, discharging the liquid contained in the tank through the discharged conduit, and discharging liquid contained in the well through the discharge conduit to a waste area remote from the apparatus and well or to metering apparatus to test the liquid discharged from the well. A schematic representation of the tank 14, the pumping system 16, and the fluid conduit network is provided in FIG. 6 to assist in the following explanation of the operation of the apparatus 10.

Each of the above-described functions is performed by a single operator of the apparatus standing on the rear platform 30 by manually manipulating the seven valves A–G and the pump motor on/off switch 102. In a typical use of the apparatus, chemicals to be mixed with water and used in the rehabilitation of the well are poured into the tank interior volume 46 through the access opening 54 in the top of the tank. Water is supplied to the tank interior for mixing with the chemicals by the external source of water connected to one of the two fill conduits 70, 72. By opening the corresponding manual valve A, B for the fill conduit connected to the source of water, the operator supplies water from the external source to the tank interior to be mixed with the chemicals. Once the tank is filled, the operator next activates the pump motor by depressing the electric switch 102. The pump motor 66 drives the injection pump 64 drawing liquid from the tank interior through the first conduit 76, the pump 64, and the second conduit 78 to the manifold 82. To thoroughly mix the chemicals and the water contained in the tank, the return conduit valve C is opened with the other valves closed. This will cause the liquid pumped from the tank to be recirculated through the manifold 82 and the return conduit 86 and then through the distribution conduit 88 and the pair of nozzles 90. The liquid output from the mixing nozzles 90 is directed against the Gussets 48 in the tank interior creating turbulence in the liquid contained in the tank and thoroughly mixing the water and chemicals.

With the liquid thoroughly mixed in the tank interior, it is next injected into the well to be rehabilitated. To perform the injection function of the apparatus, the manual valve D on the output conduit 92 is opened with all other valves being closed. This causes the contents of the tank to be pumped through the output conduit 92 and the length of hose connecting it with the well (not shown) into the well.

If surging of the well is required, the liquid which has been injected into the well can be pumped back out into the tank interior using the well pump (not shown) to pump surged liquid from the well through the input conduit 96. To perform the surging operation valves C, E and G are opened with all other valves closed. Liquid surged from the well will then be pumped by the well pump back into the tank interior volume.

To discharge the contents of the tank to a test meter or waste area through the discharge conduit 98 valves E and F are opened with all others closed. This will cause the tank contents to be pumped through the first conduit 76, the pump 64, the second conduit 78, the manifold 82, a portion of the input conduit 96 and the discharge conduit 98 to the meter or the waste area away from the apparatus and the well.

To pump the liquid in the well from the well to a waste area or to a test meter to evaluate the performance of the well cleaning procedure, the well pump (not shown) is used to pump the liquid from the well and to the input conduit 96 through the length of hose connecting the conduit with the well. The manual valves F and G are opened with all other valves closed. The well pump will cause liquid from the well to be pumped through the input conduit 96 and the discharge conduit 98 to the test meter or waste area away from the apparatus and the well.

All of the above described operations capable of being performed by the apparatus of the invention can be performed by a single operator standing on the rear platform 30 of the apparatus.

While the present invention has been described by reference to a specific embodiment, it should be understood that modifications and variations of the invention may be constructed without departing from the scope of the invention defined in the following claims.

What is claimed is:

1. A well rehabilitation apparatus comprising:

a wheeled vehicle;

a tank supported on the wheeled vehicle, the tank having an interior volume for containing liquid;

a pump supported on the wheeled vehicle; and, a network of liquid conducting conduits interconnecting the pump and the tank interior volume, the network comprising means for drawing a liquid from the tank interior volume and circulating the liquid through the pump and back into the tank interior volume, means for drawing a liquid from the tank interior volume and directing the liquid through the pump and into a well separate from the wheeled vehicle, and means for drawing a liquid from the tank interior volume and directing the liquid through the pump and discharging the liquid from the wheeled vehicle and away from the well.

2. The apparatus of claim 1, wherein:

the network of liquid conducting conduits further comprises means for directing liquid from a well separate from the wheeled vehicle and into the tank interior volume.

3. The apparatus of claim 1, wherein:

the network of liquid conducting conduits further comprises means for directing liquid from a well separate from the wheeled vehicle to the wheeled vehicle, and then away from the wheeled vehicle and the well.

4. The apparatus of claim 1, wherein:

the network of fluid conducting conduits further comprises a plurality of valves for controlling flow of a liquid through the network of fluid conducting conduits, the plurality of valves being manually accessible from one area of the wheeled vehicle.

5. The apparatus of claim 4, wherein:

the wheeled vehicle has an operator's platform supported thereon and the plurality of valves are manually accessible from the operator's platform.

6. The apparatus of claim 1, wherein:

the means for drawing a liquid from the tank interior volume and circulating the liquid through the pump and back into the tank interior volume includes at least a pair of nozzle inside the tank interior volume positioned at separate areas of the tank interior volume, the pair of nozzles mixing liquid circulated through the pump and back into the tank interior volume with liquid contained in the tank interior volume.

7. The apparatus of claim 1, wherein:

the means for drawing a liquid from the tank interior volume and circulating the liquid through the pump and back into the tank interior volume includes a first conduit extending between the tank and pump and connecting the tank and pump in fluid communication, a second conduit extending from the pump to a manifold having a plurality of branch conduits extending therefrom, the second conduit connecting the pump and the manifold in fluid communication, and a return conduit of the plurality of branch conduits, the return conduit extending from the manifold to the tank and connecting the manifold and the tank interior volume in fluid communication.

8. The apparatus of claim 7, wherein:

the means for drawing a liquid from the tank interior volume and directing the liquid through the pump and into a well separate from the wheeled vehicle includes the first conduit, the pump, the second conduit and the manifold, and also includes an output conduit of the plurality of branch conduits, the output conduit extending from the manifold and being adapted to connect the manifold and the well in fluid communication.

9. The apparatus of claim 8, wherein:

the means for drawing a liquid from the tank interior volume and directing the liquid through the pump and discharging the liquid from the wheeled vehicle and away from the well includes the first conduit, the pump, the second conduit and the manifold, and also includes a discharge conduit of the plurality of branch conduits, the discharge conduit extending from the manifold and from the wheeled vehicle away from the well.

10. The apparatus of claim 9, wherein:

each branch conduit of the plurality of branch conduits has a manually operated valve thereon for control of a flow of liquid through the branch conduit.

11. A well rehabilitation apparatus comprising:

a wheeled vehicle;

a tank supported on the wheeled vehicle, the tank having an interior volume for containing a liquid;

a pump supported on the wheeled vehicle; and, a network of liquid conducting conduits interconnecting the pump and the tank interior volume, the network including a first conduit extending between the tank and the pump and connecting the tank and pump in fluid communication, a second conduit extending from the pump to a manifold and connecting the pump and manifold in fluid communication, and the manifold including a plurality of branch conduits, the plurality of branch conduits including an output conduit adapted to provide fluid communication from the manifold to a well separate from the wheeled vehicle, and an input conduit adapted to provide fluid communication from a well to the manifold.

12. The apparatus of claim 11, wherein:

an operator's platform is provided on the wheeled vehicle; and, a manually operated valve is provided on each of the output conduit and the input conduit with each manually operated valve being manually accessible from the operator's platform to control fluid communication through the output conduit and the input conduit.

13. The apparatus of claim 11, wherein:

the plurality of branch conduits includes a discharge conduit, the discharge conduit being connected in fluid communication with the manifold and adapted to discharge liquid from the manifold and the wheeled vehicle away from the well.

14. The apparatus of claim 13, wherein:

an operator's platform is provided on the wheeled vehicle; and, a manually operated valve is provided on each of the output conduit, the input conduit and the discharge conduit with each manually operated valve being manually accessible from the operator's platform to control fluid communication through the output conduit, the input conduit and the discharge conduit.

15. The apparatus of claim 11, wherein:

the plurality of branch conduits includes a return conduit extending from the manifold to the tank and connecting the manifold and the tank in fluid communication.

16. The apparatus of claim 11, wherein:

an operator's platform is provided on the wheeled vehicle; and, a manually operated valve is provided on each of the output conduit, the input conduit and the return conduit with each manually operated valve being manually accessible from the operator's platform to control fluid communication through the output conduit, the input conduit and the return conduit.

17. The apparatus of claim 15, wherein:

at least a pair of mixing nozzles are contained inside the tank interior volume and are connected in fluid communication with the return conduit outside the tank, the pair of mixing nozzles are positioned at separate areas of the tank interior volume to mix liquid injected into the tank interior volume through the pair of nozzles with liquid contained in the tank interior volume.

18. The apparatus of claim 11, wherein:

a fill conduit is connected to the tank in fluid communication with the interior volume of the tank, the fill conduit being separate from the plurality of branch conduits.

* * * * *